US010337314B2

(12) United States Patent
Keller

(10) Patent No.: US 10,337,314 B2
(45) Date of Patent: Jul. 2, 2019

(54) SHALLOW GROUND WATER CHARACTERIZATION SYSTEM USING FLEXIBLE BOREHOLE LINERS

(71) Applicant: Carl E. Keller, Santa Fe, NM (US)

(72) Inventor: Carl E. Keller, Santa Fe, NM (US)

( * ) Notice: Subject to any disclaimer, the term of this patent is extended or adjusted under 35 U.S.C. 154(b) by 110 days.

(21) Appl. No.: 15/169,486

(22) Filed: May 31, 2016

(65) Prior Publication Data

US 2016/0348482 A1 Dec. 1, 2016

Related U.S. Application Data

(60) Provisional application No. 62/167,501, filed on May 28, 2015.

(51) Int. Cl.

| | |
|---|---|
| ***E21B 47/04*** | (2012.01) |
| ***E21B 43/10*** | (2006.01) |
| ***E21B 49/08*** | (2006.01) |
| *E02D 1/06* | (2006.01) |

(52) U.S. Cl.

CPC ..... *E21B 47/04* (2013.01); *E21B 43/103* (2013.01); *E21B 49/084* (2013.01); *E02D 1/06* (2013.01)

(58) Field of Classification Search

CPC ..... E02D 1/06; E21B 43/103; E21B 47/04; E21B 47/084

See application file for complete search history.

(56) References Cited

U.S. PATENT DOCUMENTS 4,778,553 A 10/1988 Wood
5,176,207 A 1/1993 Keller
5,246,862 A 9/1993 Grey et al.
5,377,754 A 1/1995 Keller
5,803,666 A 9/1998 Keller
5,804,743 A 9/1998 Vroblesky et al.
5,816,345 A * 10/1998 Keller ..... B29C 63/36 175/53
5,853,049 A 12/1998 Keller
6,026,900 A 2/2000 Keller
6,109,828 A 8/2000 Keller (Continued)

OTHER PUBLICATIONS

Keller, C., "Improved Spatial Resolution in Vertical and Horizontal Holes . . . "; Remediation of Hazardous Waste Contaminated Soils; 1994; pp. 513-541; Macel Dekker, Inc.; USA.

(Continued)

*Primary Examiner* — John Fitzgerald

(74) *Attorney, Agent, or Firm* — Rod D. Baker

(57) ABSTRACT

A simplified system and method for lining a borehole in the Earth's surface. The liner has a tubing sleeve disposed upon the interior liner wall surrounding and defining the liner's interior volume when the liner is installed within a borehole. This compact and relatively lightweight system simplifies the modes and methods of subsurface installation. Each of at least one tubing sleeve preferably contains and holds at least one slender sample tubes for transporting borehole sample water (or water pressure change data) from a liner sampling spacer to above the ground's surface. The method is a relatively inexpensive, and allows for the sealing of a borehole to define various different sampling intervals with an external spacer at each liner port, and to use tubing directly to the surface from each port, to perform various subsurface sampling and monitoring functions.

19 Claims, 15 Drawing Sheets

(56) References Cited

U.S. PATENT DOCUMENTS

| | | | | |
|---|---|---|---|---|
| 6,244,846 | B1 | 6/2001 | Keller | |
| 6,283,209 | B1 | 9/2001 | Keller | |
| 6,298,920 | B1 * | 10/2001 | Keller | E21B 19/00 166/377 |
| 6,910,374 | B2 | 6/2005 | Keller | |
| 7,281,422 | B2 | 10/2007 | Keller | |
| 7,753,120 | B2 | 7/2010 | Keller | |
| 7,896,578 | B2 | 3/2011 | Keller | |
| 8,069,715 | B2 | 12/2011 | Keller | |
| 9,008,971 | B2 | 4/2015 | Keller | |
| 9,534,477 | B2 * | 1/2017 | Keller | E21B 43/103 |
| 9,797,227 | B2 * | 10/2017 | Keller | E21B 43/103 |
| 10,030,486 | B1 * | 7/2018 | Keller | E21B 43/103 |
| 10,060,252 | B1 * | 8/2018 | Keller | E21B 47/1015 |
| 2004/0065438 | A1 * | 4/2004 | Keller | E21B 47/10 166/250.03 |
| 2005/0172710 | A1 * | 8/2005 | Keller | E21B 47/10 73/152.41 |
| 2009/0003934 | A1 * | 1/2009 | Keller | E21B 49/08 405/150.1 |
| 2009/0211765 | A1 * | 8/2009 | Keller | E21B 43/103 166/377 |
| 2012/0173148 | A1 * | 7/2012 | Keller | E21B 47/10 702/11 |
| 2014/0262346 | A1 | 9/2014 | Keller | |
| 2014/0262347 | A1 | 9/2014 | Keller | |
| 2016/0047225 | A1 * | 2/2016 | Keller | E21B 49/08 73/152.28 |
| 2016/0069727 | A1 * | 3/2016 | Keller | G01F 23/14 702/55 |
| 2016/0348482 | A1 | 12/2016 | Keller | |

OTHER PUBLICATIONS

Cherry, J.A., et al.; "A New Depth-Discrete Multilevel Monitoring Approach for Fractured Rock"; Ground Water Monitoring & Remediation; 2007; pp. 57-70; vol. 27, No. 2; USA.

* cited by examiner

SHALLOW GROUND WATER CHARACTERIZATION SYSTEM USING FLEXIBLE BOREHOLE LINERS

CROSS REFERENCE TO RELATED APPLICATIONS

This application claims the benefit of U.S. Provisional Patent Application Ser. No. 62/167,501 entitled "Shallow Ground Water Characterization System Using Flexible Borehole Liners," filed on 28 May 2015, the entire disclosure of which is hereby incorporated by reference.

BACKGROUND OF THE INVENTION

Field of the Invention

This invention relates to a multi-level ground water characterization method and apparatus using flexible borehole liners and associated components to perform water level and ground water sampling in subsurface boreholes.

Background Art

A "borehole" is a hole, e.g., a drilled shaft, into the Earth's subsurface. Borehole hydraulic conductivity profiling techniques described in my U.S. Pat. Nos. 6,910,374 and 7,281,422 have been used in many boreholes over the past decade or so. These patents, whose teachings are hereby incorporated by reference, describe the hydraulic transmissivity profiling technique which carefully measures the eversion of a flexible borehole liner into an open stable borehole. Other installations of flexible liners into boreholes, by the eversion of the liners, are used in a variety of systems and methods disclosed in several of my other patents. Those liners are usually installed into the open boreholes using a water level inside the liner that is significantly higher than the water table in the geologic formation penetrated by the borehole. The use of the continuous flexible liner has a sealing advantage and other advantages as manifest in my other systems and techniques.

Over time, several methods for measuring subsurface hydrologic characteristics have been developed. The several methods have a different means of isolating discrete sampling elevations in a single borehole, obtaining ground water samples for analysis and measuring the water table at each sampling elevation. Most known methods of isolating each sampling elevation from those adjacent sampling elevations range involve various types of packers (an inflated bladder) or cast sealants, such as bentonite or grout. It also is known to isolate sampling levels using a flexible liner. The use of a flexible liner is not unique to the present disclosure.

The eversion of a flexible liner into position in the borehole does require procedures that can be slow and labor intensive in the situation of a small diameter borehole and with relatively low borehole transmissivity. Pumping the water from beneath the liner and erecting a scaffolding to achieve a sufficient driving pressure (in shallow ambient water tables) are two features that are avoided by the present system and method, in one application. It is also a limiting factor of the current flexible liner based multi-level systems that the bulk and weight of the systems prevent some attractive installation methods possible with this presently disclosed innovation.

SUMMARY OF THE INVENTIVE DISCLOSURE

According to the present invention, a flexible liner system is provided. The liner has at least one tubing sleeve disposed upon its inside face (i.e., the interior liner wall surrounding and defining the liner's interior volume when the liner is installed within a borehole). This compact and relatively lightweight liner system simplifies the modes and methods for installing it into a subsurface borehole. Each of the at least one tubing sleeves preferably contains and holds at least one, perhaps a plurality, of slender sample tubes for transporting sample water (or water pressure change data) from a liner sampling spacer to above the ground's surface. There is disclosed a system that is relatively inexpensive, and also the most simple and compact, of apparatuses and methods for sealing a borehole with a flexible liner to define the sampling intervals with an external spacer at each liner port, and to use tubing directly to the surface from each port. The flexible liner system can be everted into place as described hereafter, and the water table at each port can be measured relatively simply. Aids for the emplacement of the system into a borehole are described. And previously known methodologies are incorporated to realize the full advantages of the presently disclosed systems and process.

By the present invention, the history of the water table changes at each port in a lined borehole can be monitored with pressure transducers on the surface, where they are available for reuse or repair as needed. The compact and flexible form of the system is a paramount advantage. Because this system is much more slender and lighter than related previous designs, it can be installed in a novel manner using a surrounding hose; labor costs, and associated difficulties of everting a flexible liner into position in a borehole, are significantly reduced. The lower cost of fabrication of the present system is another marked advantage The eversion of a flexible liner into a borehole becomes more difficult as the number of liner sampling ports is increased. An innovative method also has been developed which allows this more compact version of a multi-level sampling system to be emplaced with larger diameter tubing, which does not require the eversion of the flexible liner system. Because the novel installation method, in combination with the compact characteristics of the disclosed basic sampling system, leads to an even greater reduction in the cost of the system construction and installation, they both are disclosed herein.

BRIEF DESCRIPTION OF THE DRAWINGS

The attached drawings, which form part of this disclosure, are as follows.

Figure 1:
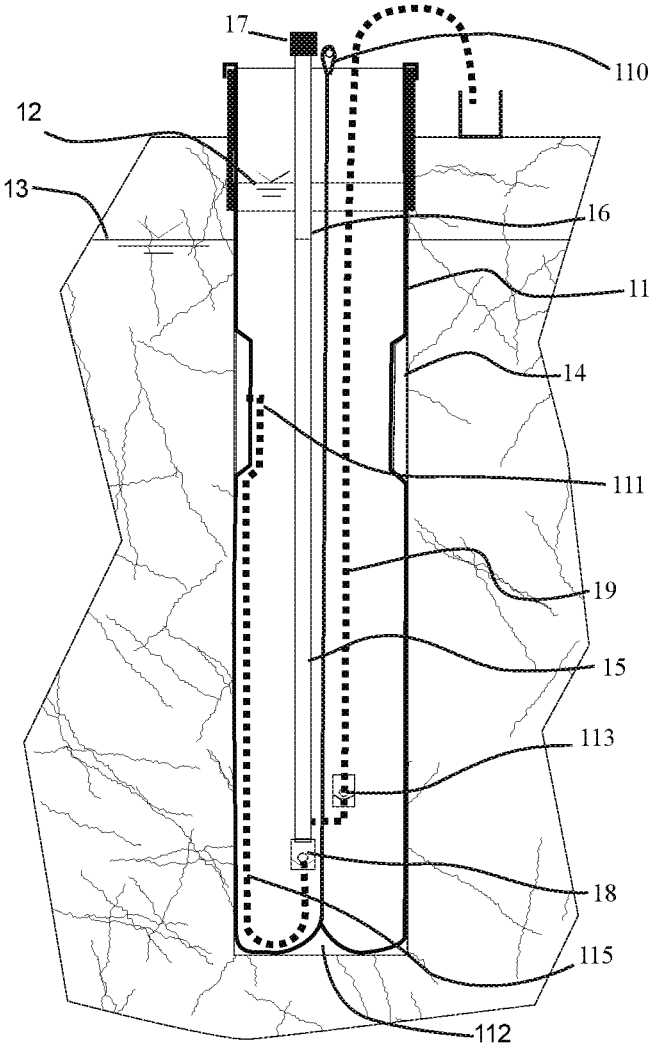
FIG. 1 is a side sectional view of a basic flexible liner system, known in the art for multi-level water sample collection in a single borehole, with hydraulic head measurements available at each sample elevation.

DESCRIPTION OF THE INVENTION (INCLUDING THE BEST MODES FOR PRACTICING THE INVENTION)

Multi-level sampling systems currently in use in subsurface boreholes and utilizing a flexible liner with ports and sampling tubes have substantial limitations of cost, weight, and the number of ports that can be installed in a typical borehole (of, e.g., three to eight inches in diameter). A means of reducing the weight of the system and the cost is disclosed in my co-pending U.S. Utility patent application Ser. No. 14/827,184 entitled "Method for Slender Tube, Multi-Level Subsurface Borehole Sampling System" (filed 14 Aug. 2015). However, such a usage and system still involves a cost and bulk which is unattractive in many situations, and still includes a central tubing bundle. An advantage of the presently disclosed system is that a cumbersome central tubing bundle is not required. According to the present invention, a flexible liner is provided with at least one tubing sleeve disposed upon its inside face (i.e., the interior liner wall surrounding and defining the liner's interior volume when the liner is installed within a borehole). Each of the at least one tubing sleeves preferably contains and holds at least one, perhaps a plurality, of slender sample tubes for transporting sample water (or water pressure change data) from a liner sampling spacer to above the ground's surface. "Slender" sample tubes have a diameter of from about 3/16 inch (0.1875 inch) up to 3/8 inch (0.375 inch), and preferably are 1/4 inch (0.250) diameter tubes. Suitable standard tube diameters thus also include 5/16 inch (0.3125 inch).

An affordable system must still be able to isolate the sampling intervals from adjacent intervals, obtain water samples, and make water table measurements for the elevation of each sampling interval. Additional attractive objectives are minimum labor for construction, minimum shipping weight, and ease of installation. For these advantages, there can be some compromise in the sampling procedure and the water table (hydraulic head) measurement. The system of the present disclosure is perhaps the most attractive design to meet these objectives. There yet is one other compromise for a design of minimized expense; it is that the basic system cannot obtain a water sample if the formation water table is more than approximately 25 feet below the ground's surface. Another embodiment at slightly greater cost is not so limited, and still has the advantages of flexibility and compact dimensions. It is advantageous also that the presently disclosed system and method are also suitable for pore gas sampling, as described generally in my U.S. Pat. No. 5,176,207.

Thus the present invention exploits the techniques and mechanisms of previous systems and methods developed by this applicant (for example, U.S. Pat. Nos. 5,176,207, 7,753,120, 7,841,405, and 8,424,377, the disclosures of which are incorporated herein by reference), but much more affordably and efficiently. The present system and method also enhances the utility of the more recent invention of a water level measurement in slender tubes as disclosed in my co-pending U.S. Utility patent application Ser. No. 14/846,243 entitled "Method for Air Coupled Water Level Meter System," (filed on 4 Sep. 2015, and also incorporated herein by reference), to obtain the least expensive multi-level ground water sampling and head measurement system for the unique situation of relatively shallow water table situations where common peristaltic pumping from the surface is possible. For deeper water tables, the somewhat more expensive system of my Utility patent application Ser. No. 14/827,184, filed 14 Aug. 2015, has been designed.

Reference is invited to FIG. 1, illustrating a basic version of a currently known borehole flexible liner eversion system, called in the trade a "Water FLUTe" system, which is conveniently used for water sampling and head measurement, and which can be used under most hydrologic circumstances. However, it is relatively heavy, must be shipped on a large reel because of the sampling/pumping tubing diameter needed to measure the water table depths, and is the more expensive of the flexible liner multi-level sampling systems also used for head measurements. The essential features of the design are the liner 11 which forms a continuous seal of the uncased borehole 112, the spacer(s) 14 which defines an unsealed portion(s) of the borehole, the liner port 111 behind the spacer 14, the descending tube 115 leading to the pumping subsystem, two check valves 18 and 113, and a large diameter pump tube 15 and a smaller diameter tube 19, both of which are used for the sample pumping procedure. Other features are the tether 110 which supports the pumping subsystem, and a quick connection 17 at the top of the pump tube 15 for convenient connection to a gas pressure source to operate the pumping subsystem. In a typically completed system, the tubing assembly shown in FIG. 1, along with the spacer, is duplicated (not shown) for each respective discrete sampling interval, in a plurality of intervals, for which sampling is desired. The location of each spacer 14 defines that portion of the geologic formation (at a different elevation/depth) from which a water sample is drawn. The several tubing systems of the plurality are formed into a central tubing bundle supported by the tether 110. The foregoing system, which effective for its intended purpose, can be bulky, cumbersome to install, and its complexity compared to the presently described system also contributes to its greater expense.

Figure 2:
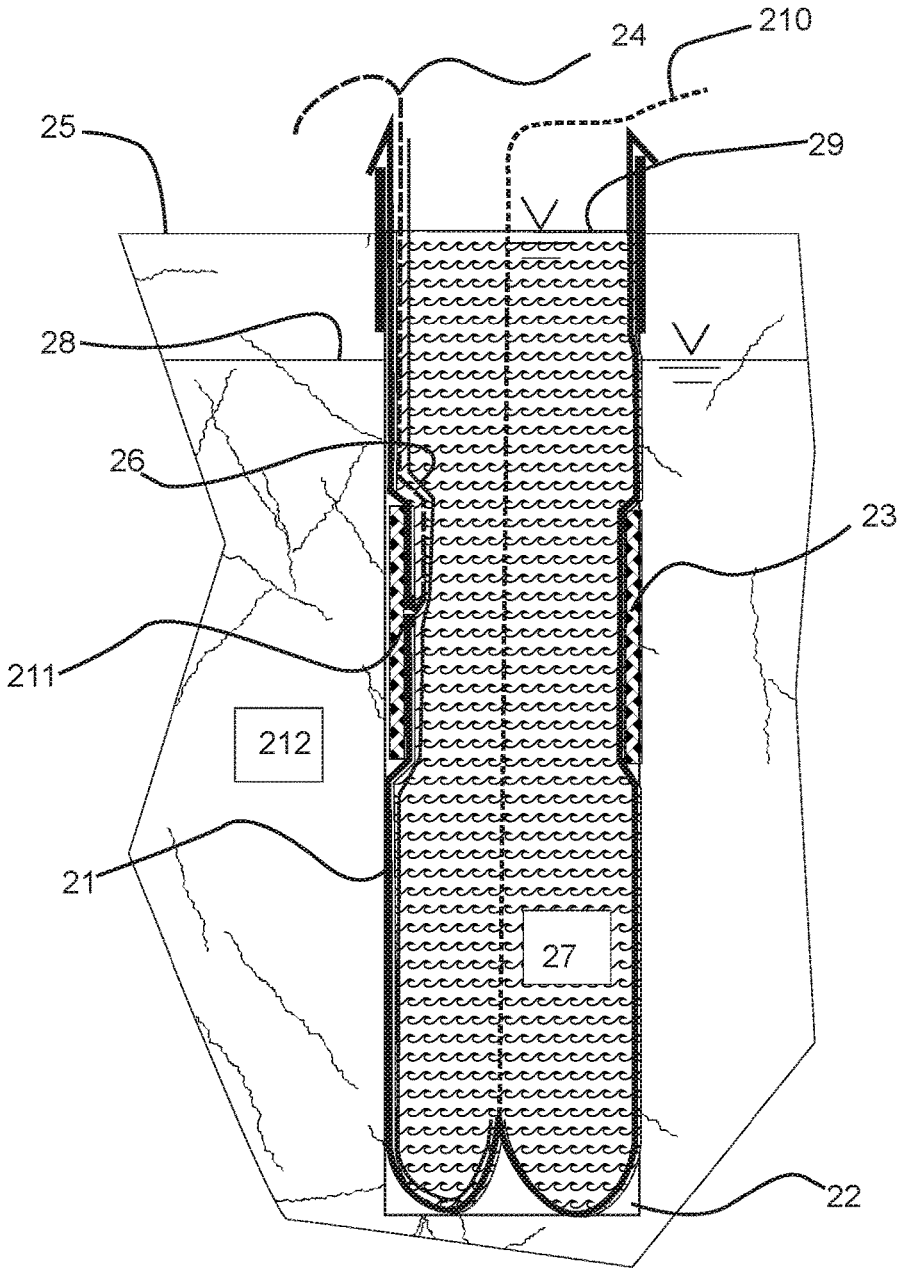
FIG. 2 is a side sectional view of an embodiment of the presently disclosed system, for the least expensive form of multi-level measurements.

Reference is turned to FIG. 2, illustrating embodiment basics of a system according to the present disclosure, with a liner installed in place within a borehole. The liner 21 seals the wall of the borehole 22, the spacer 23 (on the outside of the everted installed liner, next to borehole wall) defines the sampling interval (an unsealed interval), and in this system the slender tube 24 from the spacer 23 ascends to the surface 25, instead of descending to the pumping subsystem (as seen in the system of FIG. 1). The spacer 23 is an annular surround of the tubular liner 21. However, an even more compact alternative design employs a spacer which not a fully circumferential surround of the liner. Water can flow from the formation 212 into the spacer 23, through the interstitial space of the spacer 23, to and through the liner port 211, and into the ascending slender tube 24. The slender tube 24 is situated, held, and contained in a tubing sleeve 26 of highly flexible material welded to the interior surface of the everted liner 21; the main liner wall is between the sleeve and the borehole wall when the liner is installed in the borehole. Each tubing sleeve 26 preferably is a narrow strip of flexible reinforced fabric, or the like, whose axially extending edges are affixed to the liner inside wall, preferably by welding, or alternatively by stitching or chemical adhesives. The medial portion of the sleeve strip between its axial edges remains unsecured to the liner wall, thus defining (radially between the strip and liner wall) an axially extensive sleeve for containing and holding one or more slender sampling tubes 24. A particular sleeve 26 typically runs the complete axial length of the liner, and in any event extends along at least a major segment of the liner's length, i.e., from the port 211 to above the surface 25. A system according to this disclosure features at least one tubing sleeve. The liner preferably includes two sleeves 26, which may be disposed on diametrically opposite sides of the liner interior. Each sleeve 26 preferably may house and hold up to six slender tubes (each in communication with an operatively associated spacer 23), thereby permitting a system in a single borehole to monitor and sample separately the conditions at up to twelve discrete sample intervals.

Again, it is to be understood that the tubing system of FIG. 2 can be duplicated a plurality of times on a single liner in a given borehole. A liner 21 may have one or two sleeves 26, and a plurality of spacers 23, with each spacer disposed at a pre-determined location (i.e., elevation depth in the borehole). Each of a plurality of spacers 23 has an operably associated slender tube 24 in fluid communication therewith (via a liner port 211), and each slender tube runs from its spacer, within and long the interior of an ascending portion of a slender tube sleeve 26, to the surface of the ground. FIG. 2 shows one spacer and one slender tube; description of the single-spacer arrangement of FIG. 2 serves to describe a multi-spacer embodiment of the system, which is achieved by duplicating the arrangement of FIG. 2 but with the spacers at differing elevations.

The tether 210 is used to aid the installation of the flexible liner by a process called eversion (now well-known, described for example in U.S. Pat. No. 7,281,422), and as suggested in FIG. 3 below). Other installation methods described hereafter use a tube instead of a tether connected to the closed end of the liner. As suggested by FIG. 3, the impermeable liner 21 is pressurized by being filled to a surface level 29 with water or a heavy mud, in accordance with known art. The liner is urged against the borehole wall by the pressure of the interior water 27 in excess of the water pressure in the formation 212 (formation pressure indicated by the elevation of the ambient water table 28). With this system the liner 21, spacer 23 and slender tube 24 are sufficiently light and flexible to allow the liner (with slender tubes) to be everted into the borehole 22 from a relatively small shipping reel—in contrast with the system of FIG. 1.

For the sake of simplicity of illustration, FIG. 2 depicts only a single slender tube 24 in a sleeve 26 within the liner 21; as mentioned, in a practical system according to the present disclosure, the system typically has a plurality of spacers 23 attached to the exterior of the liner 21, and a corresponding number of slender tubes 24 extending from respectively associated spacers, each leading to the surface. Accordingly, there is a plurality of elevations from which a user can measure the hydrologic conditions of water quality, and pressure head, for a single borehole. FIG. 2 also reveals the simplicity of a system design according to this disclosure, which leads to its low weight, ease of installation and lower cost. The need for the larger diameter tubes (and compiled central tubing bundle) and valves of the pumping subsystem of FIG. 1 is eliminated As described hereafter, these improvements are possible because the function of my earlier apparatuses and systems allow now the full capabilities in this less complex and less expensive design.

Figure 3:
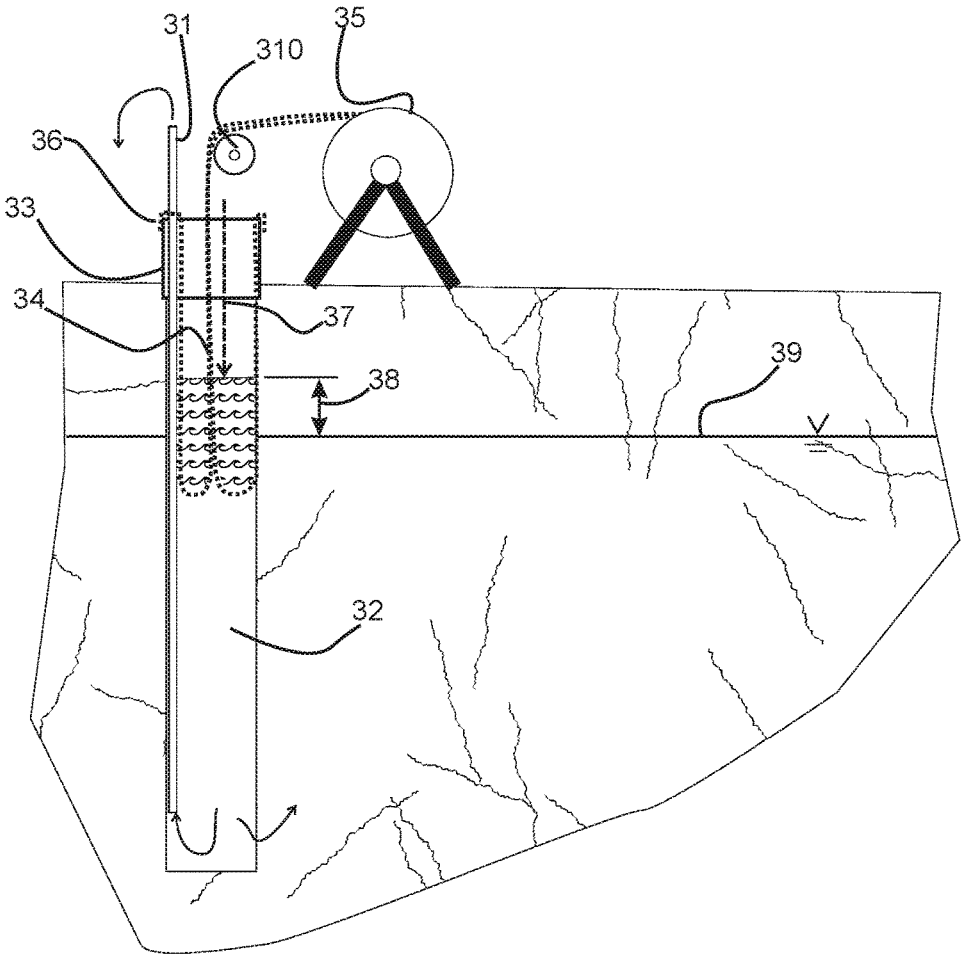
FIG. 3 is a side sectional view of the embodiment seen in FIG. 2, illustrating the liner being everted into the borehole with water or a heavier fluid.

FIG. 3 shows a basic embodiment of the present system undergoing eversion into a borehole 32. A water removal tube 31 first is lowered near to the bottom of the borehole 32 to allow the ambient water otherwise trapped beneath the everting liner 34 to be pumped or otherwise drawn to the surface (and out of the top of the borehole). Usually, a well surface casing 33 extends from the borehole uppermost portion and from the top of the borehole 32. The liner 34 is shipped, inside out, from the factory on a reel 35. Notably, the reel 35 useable with the present system can be comparatively lightweight, owing to the slenderness of the present liner/tubing system.

The liner 34 is deployed from the shipping reel 35 directly, or over the roller 310, as follows: The open end 36 of the liner 34 is slipped over the open end of the casing 33, where it is clamped to the casing 33. The flexible liner 34 is pushed, by hand, down inside the upper reach of the casing 33 to form an annular pocket in the liner. Water 37 is added (dashed directional arrow in FIG. 3) to that annular pocket space. The water pressure in the liner drives the liner 34 down the borehole by the process of eversion (the opposite of inversion), turning the liner "outside in" so that the spacers formerly disposed inside the liner are "flipped" to the outside of the liner, next to the borehole wall. The tubing sleeve 36 in FIG. 2) is within the interior of the everted, installed liner. The liner descent draws the liner from the shipping reel 35. The intermediate water level 38 inside the liner 34 relative to the water table 39 in the surrounding geologic formation creates a pressure differential that causes the liner to be urged against the borehole wall, thereby sealing the borehole 32 when the liner 34 has fully descended (e.g., as illustrated in FIG. 2). There are several commonly known pumping systems, including a peristaltic pump or air lift pumping, suitable for use in pumping ambient water out of the borehole 32, via the removal tube 31 (the ambient water otherwise trapped beneath the everting liner 34).

After the liner 34 has reached the bottom of the borehole (as in FIG. 2), the tether (element 210 in FIG. 2) is secured to a surface support to prevent its further descent. Then, a portion of the water fill 27 (FIG. 2) of the liner is removed with a pump lowered into the liner, thereby partially collapsing the liner 34; the liner is collapsed sufficiently such that the water removal tube 31 can be withdrawn from the borehole without appreciable inhibiting frictional resistance of the liner 34 (FIG. 2) against the tube 31. The liner (seen as element 21 in FIG. 2) is then refilled to the intermediate elevation 38 (FIG. 3) with water to cause the liner 34 again to dilate against the borehole wall, thereby achieving a seal of the borehole wall. Thus positioned, the dilated liner 21 then is able to isolate from adjacent spacers each respective spacer (element 23 in FIG. 2) on the liner. Thus installed, the system allows water to be withdrawn from the surrounding geologic formation only in the interval of the borehole defined by each corresponding spacer 23. In some embodiments of the system and method, the pressurizing fluid 27 inside the liner 21 may be a heavy mud or other fluid, providing the greater interior pressure needed to seal the liner against the borehole wall. One possible approach for sealing the liner in a borehole with a high water table in the formation 212 (FIG. 2) is disclosed in my U.S. Utility patent application Ser. No. 14/214,756 ("Method for Sealing of a Borehole Liner in an Artesian Well").

Referring again to FIG. 2, after the liner 21 is everted into position, the interior slender tube 24 in the liner sleeve 26 fills with water flowing from the formation 212, into the spacer 23, and through a port 211 behind the spacer (and then into the interior tube 24). The water level in a given tube 24 equilibrates with the level of the water table in the formation at the height (e.g., as correlated with down hole depth) of the corresponding spacer associated with that particular tube.

Figure 4:
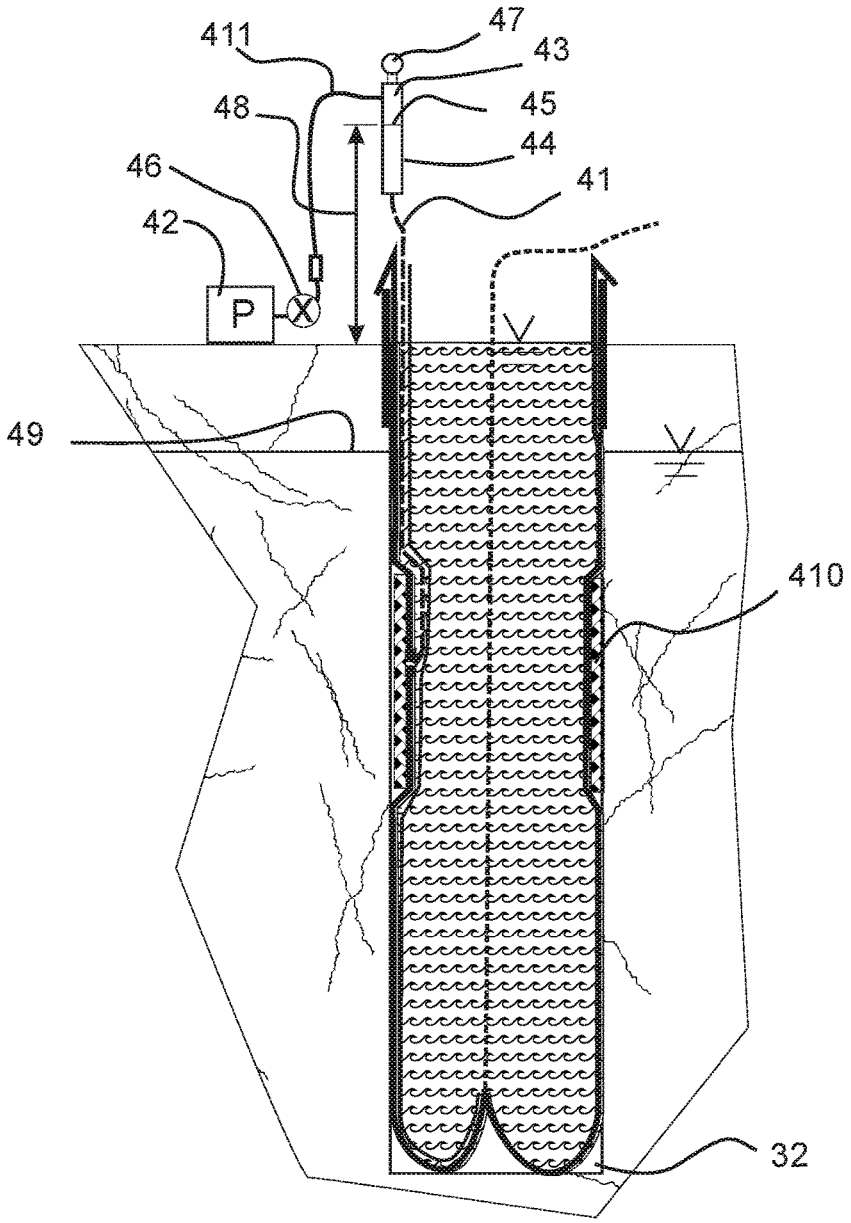
FIG. 4 is a side sectional view of an embodiment of the presently disclosed system, illustrating water being drawn to the ground's surface, into an enlarged tube, to allow a water table measurement.

Reference is invited to FIG. 4 which illustrates a means for measuring the water level in the slender tube 41 (corresponding to the slender tubes of FIGS. 2 and 3) leading upward from an associated spacer 410, according to the present system. A vacuum water level meter system is connected to the top end (or near the top end) of the slender tube 41, above the surface, so to be in fluid communication with the tube. A vacuum pump 42 is connected, via an intermediate tube 411, to the top of a larger-diameter meter tube 44, and a vacuum is applied to the meter tube 44. The top or an upper portion of the slender tube 41 is in fluid communication with the bottom of the meter tube 44. By controlled operation of the pump 42, the water level from slender tube 41, originally at first level 49 (i.e., the elevation of the pertinent subsurface water table), rises under the influence of the vacuum into the meter tube 44 to a second water level 45 inside the meter tube 44. A valve 46 (intermediate to the meter tube 44 and the vacuum pump 42) then is closed to isolate the pump 42 to prevent a further rise of the water level 45 in the meter tube 44. A vacuum gauge 47 at the top of the meter tube 44 displays the magnitude of the vacuum existing in the meter tube space 43 above the second water level 45 in the meter tube 44. The measured height 48 of the second water level 45 above the surface of the ground then is subtracted from the height of an equivalent water column of the vacuum measured at the vacuum gauge 47. This calculated difference is equivalent to the depth of the first water level 49 (in the tube 41) below the ground's surface before the vacuum was applied. In this manner, the depth to an ambient water level 49 in each (of a plurality) tube 41 connected to each operably associated spacer 410 can be determined. This method is possible even though the tube 41 connected to the spacer 410 is slender and comparatively flexible, and thus would not allow a conventional water level monitoring and measurement using an electric water level meter lowered into the tube 41.

Figure 5:
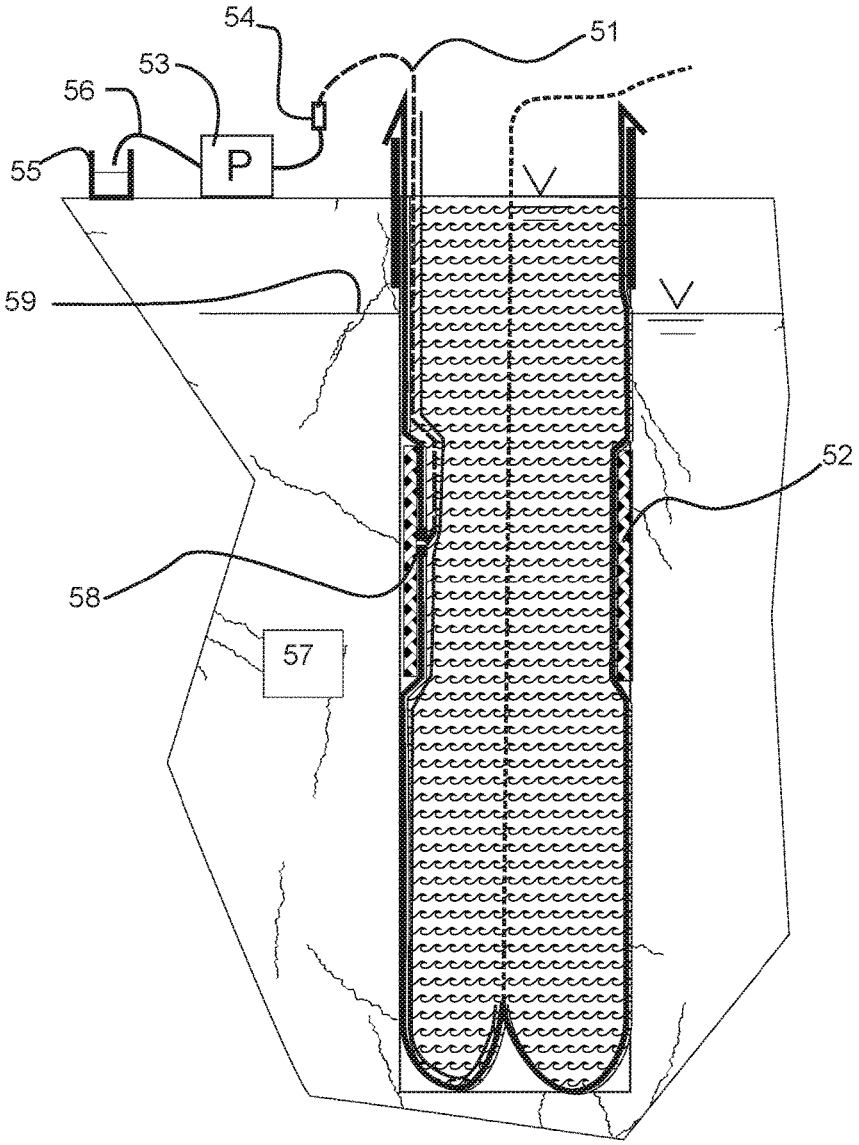
FIG. 5 is a side sectional view illustrating a system and apparatus for performing a water sample collection according to the present disclosure.

FIG. 5 illustrates that a borehole water sample can be drawn from each slender tube 51 (only one shown of a plurality, as corresponding to the slender tubes of FIGS. 2 and 3) connected to each respective one (of a plurality) of spacers 52 (one shown in FIG. 5 for the sake of clarity) situated at desired locations/elevations within the borehole. A vacuum pump 53, by preferable example a peristaltic pump, is in fluid communication with an intermediate tube 54 at the surface. Operation of the peristaltic pump 53 applies a controlled vacuum to the top or an upper portion of the slender tube 51, which vacuum (via intermediate tube 54) draws the water sample into the slender tube 51 from the spacer 52, and causes the water level to rise in the tube 51 until it reaches the pump 53. The pump 53 expels that water into a sample container 55 through discharge tube 56 (the pump drawing a vacuum on the water in the slender tube 51). This ability to draw water from the subsurface formation 57, through the spacer 52 and liner port 58, and then through the slender tube 51 to the ground's surface normally is possible only if the depth to the corresponding ambient water table 59 is less than one atmosphere equivalent water column (or about thirty-three feet). For the practical vacuum developed by a peristaltic pump, the water table 59 of interest must be about 25 feet or less below the ground's surface. The presently disclosed system accordingly is referred to as a "Shallow Water FLUTe System." Its use is contemplated particularly in those circumstances where the water table 59 (at each corresponding liner port 58) is within approximately 25 feet of the surface. This system and technique has utility even though the slender tube 51 running from the surface to the spacer 52 is slender and flexible. An alternative embodiment, which can be used for deeper water tables and still retain the compact nature of this design, is described hereafter.

Figure 6:
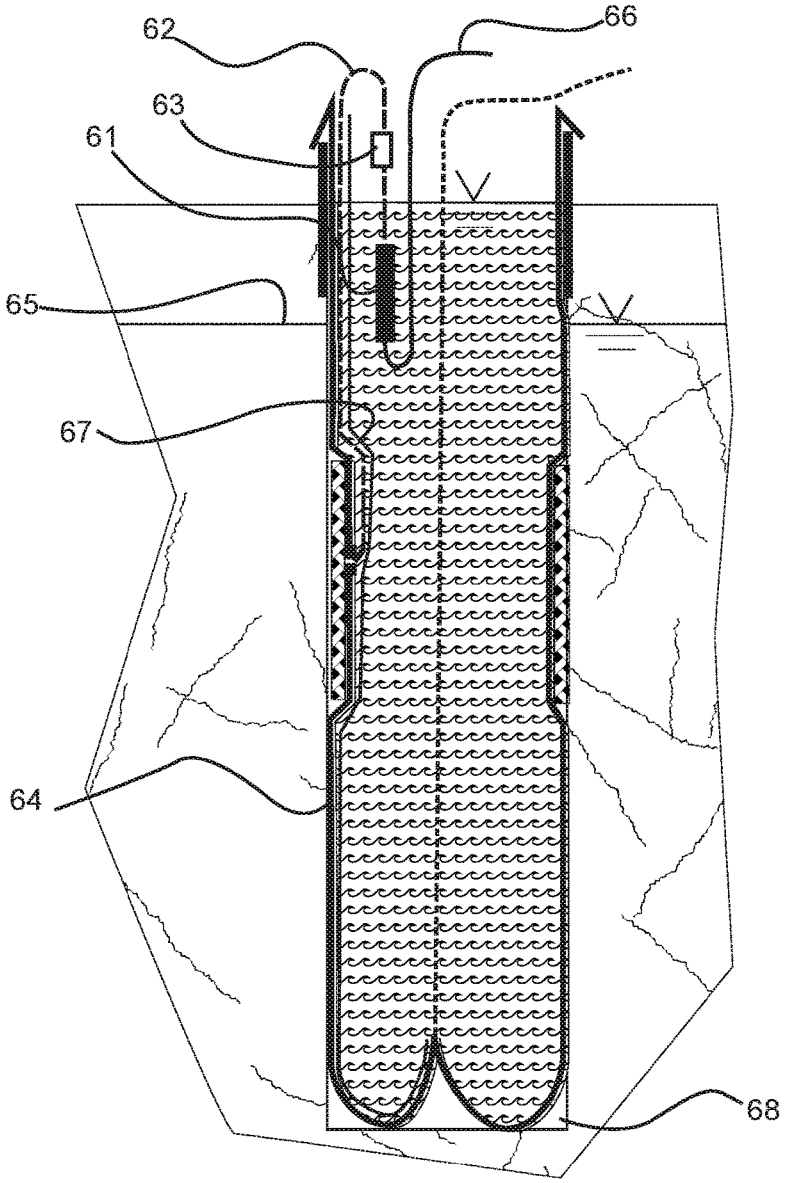
FIG. 6 is a side sectional view diagramming the geometry of an embodiment of the presently disclosed system, in use in beneficial connection with a previously known technique for the monitoring of the history of water table variations.

It often is desirable to be able to monitor continuously in time, for a given borehole, the water level in each slender tube. As the water level in the subsurface formation changes, the water level changes in a slender tube in fluid communication with the formation. FIG. 6 illustrates how a known apparatus and process (disclosed by U.S. Pat. No. 8,424,377, the entire disclosure of which is hereby incorporated by reference) may be exploited and substantially enhanced by implementing the system of the present disclosure. The innovative combination realizes a continuous water-level monitoring advantage. A user of the present system is able to connect, while the transducer is above the ground's surface, a pressure transducer 61 to an upper portion or the top end 63 of the slender tube 62 so that the transducer is in pressure communication with the interior of the slender tube. The transducer 61 preferably then is lowered into the interior of the liner 64, and beneath the water within the liner (as seen in FIG. 6), to isolate the transducer 61 and tube 62 from temperature changes which can affect the pressure measured in the air trapped in the slender tube 62 between the transducer 61 and the elevation of the water table 65. As the level of the water in the tube 62 (corresponding to the level of the monitored water table 65) changes (rises or drops), the transducer 61 detects and measures the resulting pressure change within the slender tube, from which a system operator can calculate the change in the corresponding water table elevation. Changes in the detected pressure are transmitted (via wire or wirelessly) to a recording device, such as a computer. For example, a communication cable 66 from the recording transducer 61 allows the pressure history in the slender tube 62 to be monitored and recorded, for example by being downloaded to a computer. A tremendous advantage realized by using the sleeved slender tube system of this disclosure is that the slender tube 62 in the liner sleeve 67 (generally analogous to the sleeve 26 of FIG. 2) can be used for the pressure measurement and monitoring. Such a slender tube 62 (e.g., approximately ¼ inch (0.25 inch) diameter, is sufficiently flexible, and of such reduced bulk, as to be contained in the interior sleeve 67 of the liner 64, which allows the liner 64 to be easily everted into position in the borehole 68. Fluctuations in the ambient water table 65 accordingly thereafter can be monitored by a transducer, and yet the means for doing so can be installed by eversion down the borehole 68.

Figure 7:
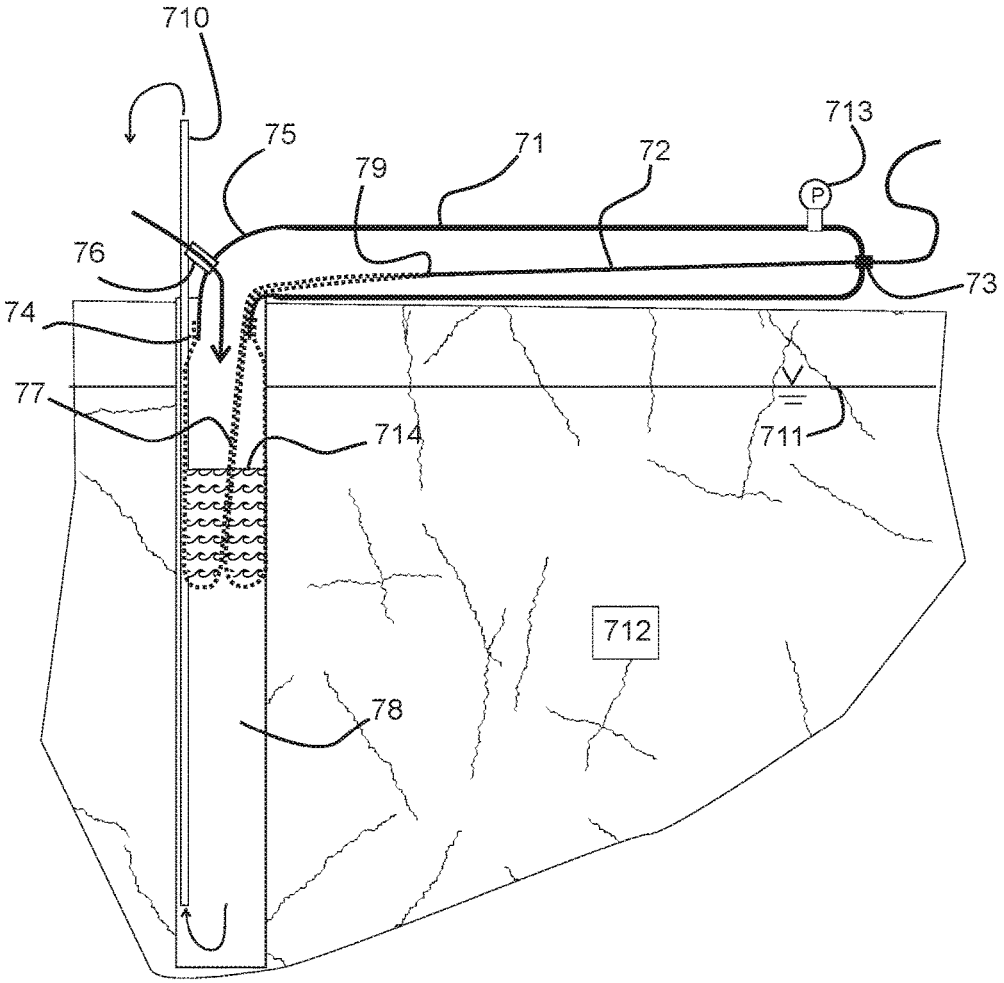
FIG. 7 is a side sectional view of a an embodiment of the system according to the present disclosure, showing an installation of a compact system from a hose canister into a shallow borehole using a combination of pressurizing fluids.

FIG. 7 illustrates another emplacement method facilitated by the compact and flexible system according to the present disclosure. In the alternative embodiment of FIG. 7, the compact flexible liner system is installed from a hose canister into a shallow borehole, in a manner somewhat reminiscent of the modes disclosed in U.S. Pat. Nos. 5,803,666, and 5,816,345, and 5,853,049, using a combination of pressurizing fluids. But in contrast to the known modalities, which are typified by the system of FIG. 1, the presently disclosed system of liner, spacer, slender tube and tether can be drawn into a comparatively much smaller diameter hose 71 (e.g., a three-inch (3") to four-inch (4") diameter hose, sometimes called a hose canister). Because there is no long central tubing bundle included in the presently disclosed system, the hose canister can be half the length otherwise required for a previously know system such as that of FIG. 1. The tether 72 therefore can be pulled through a sealing gland 73 in the sealed end of the hose 71. The open end 74 of the liner 77 can be folded over the open end of a sweep elbow 75 attached to the open end of the hose 71. As the pressure within the hose 71 is increased by air injection at the inlet 76, the hose 71 dilates and becomes relatively rigid, resembling a pipe. The resulting air pressure against the end of the inverted liner 77 acts in a manner similar to the water pressure of the water fill depicted in FIG. 3, and causes the liner 77 to evert. If the sweep elbow 75 is inserted into the upper extent of a borehole 78 or other passage, the liner 77 everts down into the borehole or passage 78, provided the tension in the tether 72 is sufficiently low to allow the eversion. The tether 72 thereafter is allowed to pass through the gland 73 at the closed end of the hose 71 in order to follow the everting end 79 of the liner 77. FIG. 7 also shows the use of a water removal tube 710, often optional but that sometimes may be required to remove the water from beneath the liner 77 while the liner descends by eversion. Because the pressure in the hose 71 and liner 77 can be adjusted to well above the ambient hydraulic head (per the ambient water table 711 in the surrounding geologic formation 712), it is possible to force the water in the borehole 78 beneath the everting liner 77 up and out the water removal tube 710 without the need of a pumping system connected to the water removal tube 710.

If the liner 77 is everting into a water-filled borehole, it may be convenient to change the fluid injected at the injection inlet 76 from air to water to offset the hydraulic pressure in the water-filled borehole 78. By monitoring the interior pressure of the hose 71 at a pressure gauge 713, a user can adjust the air (or water) flow to cause the desired liner extension by eversion of the liner 77 into the borehole 78 or other passage. An advantage of this approach is the ability to apply a much greater liner driving pressure than would otherwise be available using a simple fixed volume of water fill 714, most particularly when the ambient water level in the borehole 78 is very shallow, or the borehole is of a small diameter (which requires a greater driving pressure for the liner installation). The basics of this mode of eversion, i.e., the utilization of a surface hose, are suggested by my U.S. Pat. No. 5,803,666, but for such a different purpose (to line a hole while following behind a drill in a horizontal hole) that its adaptation herein yields a wholly unexpected advantage.

Because an object of the system according to the present disclosure is the provision of a very compact and flexible liner, the water sampling liner herein can be everted into boreholes with very shallow water tables. If necessary, a heavy mud can be injected at the inlet 76 in the embodiment of FIG. 7, and thereby provide a greater sealing pressure of the liner 77 against the borehole wall. Presently disclosed is the innovative use of a surface hose 71, to realize the advantages of the compact "Shallow Water FLUTe" liner system including a sleeved flexible slender tube.

Figure 8:
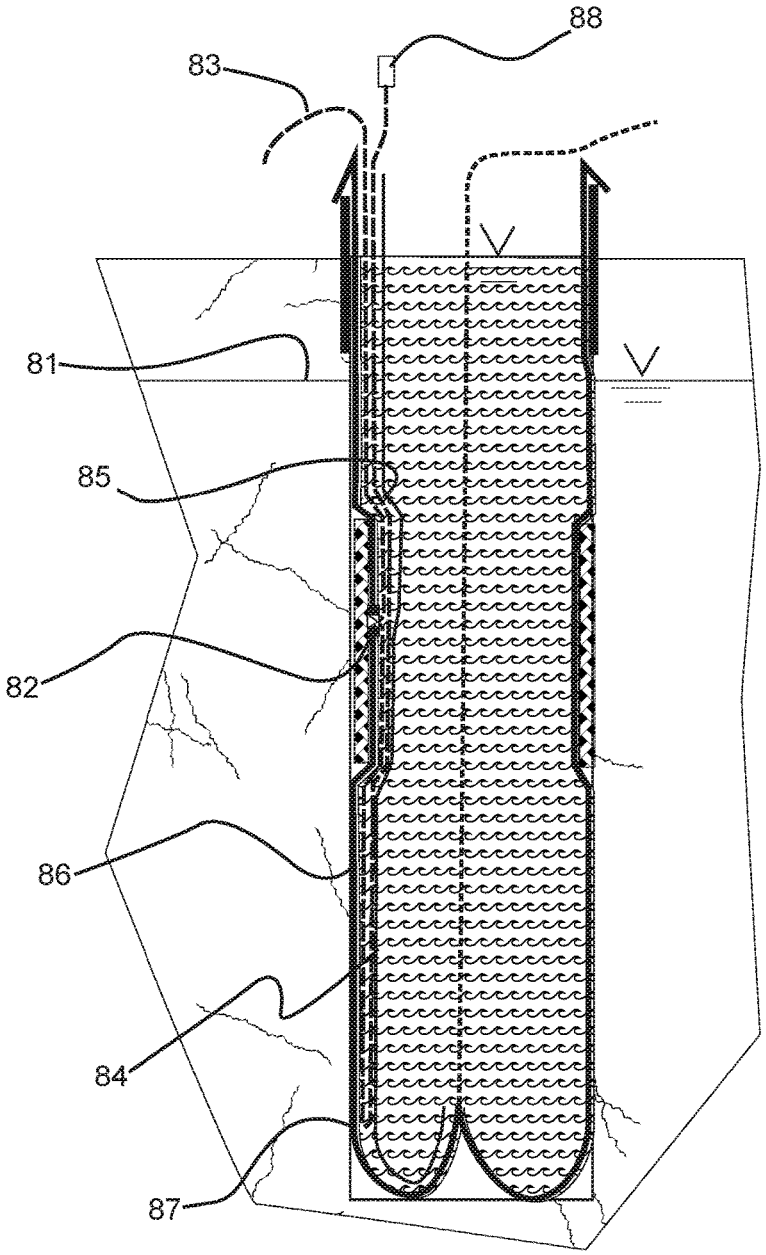
FIG. 8 is a side sectional view showing a compact version of a system according to the present disclosure, which can obtain water samples using positive displacement pumping.

FIG. 8 illustrates another embodiment of the presently disclosed compact flexible system which does not require that the water table of interest (e.g., water table 81 at an elevation seen in the figure) at each liner port 82 be less than approximately twenty-five feet below the surface of the ground. In this embodiment, a first slender tube 83 leading to the surface and ascends within and is held by the longitudinal tube sleeve 85. The first slender tube 83 is connected to the port 82 in the liner 86 by means of a tee fitting, which also is connected to a second slender tube 84. As shown in FIG. 8, the second slender tube 84 descends in the interior sleeve 85 of the liner 86, extends to near the bottom 87 of the sleeve, and then reverses direction (e.g., turns through 180 degrees) thereby to continue but ascend in the sleeve 85 to a surface connection 88. In this manner, the water fills the long U-shaped composite tube defined by the segments of the first and second slender tubes 83 and 84 in communication with each other and with the port.

Figure 9:
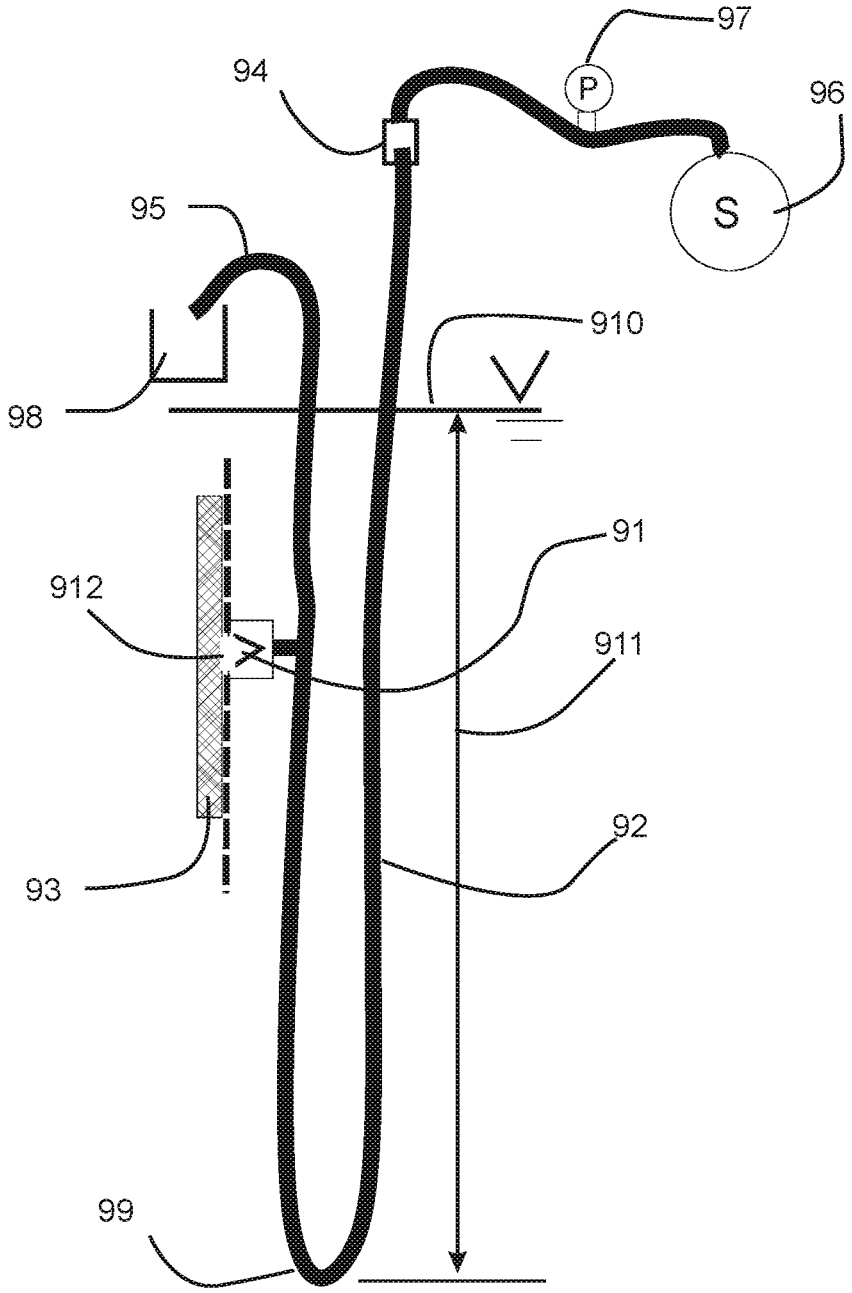
FIG. 9 shows diagrammatically selected details of the positive displacement system depicted in FIG. 8.

FIG. 9 provides an enlarged view of a portion of the tubing geometry of the system seen in FIG. 8 (in the vicinity of the tee fitting), as well as a diagrammatic exposition of the function of the FIG. 8 embodiment. A one-way valve 91, such as a common duckbill valve, is disposed at the liner port 912. The valve 91 only allows water to flow from the spacer 93 to fill the slender tube 92 (corresponding to the tube 84 of FIG. 8), and prevents water from flowing back into the surrounding subsurface formation if/when the water level in the formation descends (i.e., a falling water table). In this embodiment, the water sampling procedure includes the application of pressure to a connector 94 on the upper end of a second leg (second slender tube 84 in FIG. 8) of the U-shaped composite tube 92 defined by the segments of slender tubes (FIG. 8). The water rises up and out of the other, first leg 95 (slender tube 83 in FIG. 8) of the composite tube 92, toward its upper first end. A gas pressure source 96 is connected by the connector 94 to the top of the second leg (i.e., the top of the second slender tube 84 in FIG. 8) of the composite tube 92. The source of gas pressure 96 thus is in fluid communication (via connector 94) with the second end of the composite slender tube 92, permitting a controllable applied pressure to pressurize the length of the tube 92, thereby to expel fluid from the first end of the composite tube 92 (corresponding to the upper end of the first slender tube 83 in FIG. 8).

A pressure gauge 97 allows the user to monitor the applied pressure, and conventional regulators and valves (not shown) may be provided to control the applied pressure. When sufficient pressure, called a purge pressure, is applied to raise to the surface the water in the first, ascending, leg 95 of the composite tube 92, the sample water flow expelled from the second leg 95 can be collected in a container 98 for testing. In most water sampling procedures, it is prudent, prior to acquiring a sample water volume in container 98, to apply a relatively higher pressure to the second end of the composite slender tube 92 to expel all water from the composite tube to purge the tube of stagnant water. The applied pressure is then reduced to approximately atmospheric pressure to allow the composite tube 92 to refill with sample water from the formation, via the spacer 93 and the check valve 91 at the port 912. A sampling pressure (lower pressure than the purge pressure) is then applied at connector 94 to cause sample flow from within the tube 92 into the container 98. The lower sampling pressure preferably is maintained high enough that it does not allow the water level in the tube 92 to drop below the bottom 99 of the U-shape of the composite tube. This requisite prevents aeration of the water sample collected in the container 98.

Subsequent pumping by pressure application at the lower sampling pressure allows a larger water volume to be collected. The volume of water which can be pumped with a single pressure application depends upon the length of the tube 92 that remains submerged below the corresponding water level of interest 910 (e.g., approximately twice (2×) the distance 911 depicted by double-headed arrow in FIG. 9). The water table 910 upon refill of the tube 92 is the water level in the formation at the time of the refill. Notably, the apparatus and method of the FIG. 4 embodiment may be used to measure the water level in the tube 92. However, the check valve 91 does not allow the water level in the tube 92 to follow or track a water level descent in the surrounding geologic formation, and therefore the use of the embodiment of FIGS. 8 and 9 for continuous monitoring of the water level is not possible (as it is in the embodiment of FIG. 6). Disposing within the interior sleeve 85 (FIG. 8) of the liner 86 most or all the entire length of the U-shaped composite slender tube 92 still maintains, in this embodiment, the advantages of flexibility and compactness explained previously.

An additional advantage of this embodiment having a composite U-shaped slender tube is that the gas pressure source 96 can be connected to the second ends of several such U-shaped slender tubes associated with several discrete spacers on the liner 86 using a manifold to connect to multiple second ends of the plurality of composite tubes. Applying the gas pressure simultaneously to several tubes allows one to purge and sample multiple ports at the same time, to greatly reduce the time required to purge and sample many ports in the same liner within a single borehole. (Note that the gas pressure can be applied to either end of the U-shaped composite tube to obtain a formation water sample; the pump system function is the same).

Figure 10:
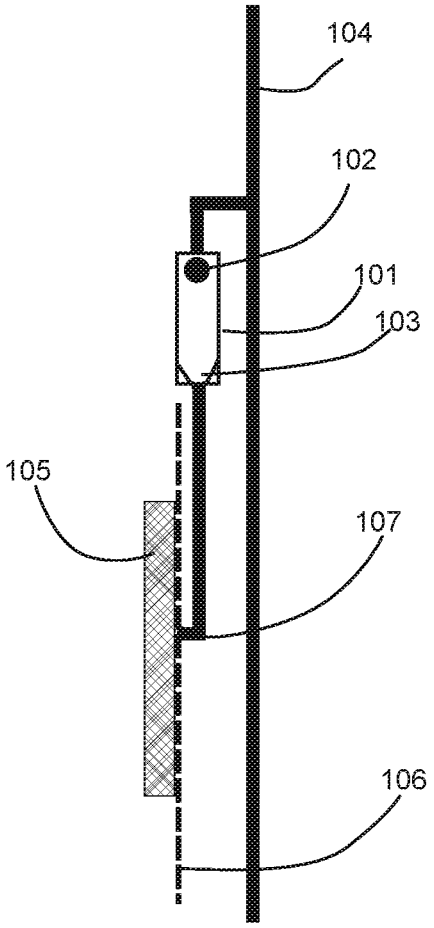
FIG. 10 is an enlarged view of a check valve design for the system of FIG. 9, which design embodiment is normally open and closes when pressure is applied to the tubing.

FIG. 10 is an enlarged view illustrating a possible design for a check valve 101 that useable in lieu of the valve 91 seen in FIG. 9. The lower end of the alternative valve 101 is in fluid communication with the port 107 in the liner 106 at the respective spacer 105. The difference is that the alternative valve 101 closes only when pressure is applied to an end of the tube 92 (FIG. 9) at the surface. The ball 102 in the check valve 101 is buoyant (e.g., composed of polypropylene), normally floats above the valve seat 103, and does not prevent flow from the tube 104 to the spacer 105. (Tube 104 corresponds hydraulically to that leg of the composite slender tube 92 of FIG. 9 to which the controlled pressure is to be applied.) Therefore, unless a sufficient pressure is applied (e.g., at the second end of the composite tube via connection 94 (FIG. 9)), the alternative valve 101 remains open, and the water level in the tube 104 can move up or down with corresponding changes in the water level 910 (FIG. 9) in the formation. In the practice of the method, a sufficient pressure application to close the valve 101 preferably is that pressure which causes a flow from the tube 104 toward the valve 101 to overcome the buoyancy of the floating ball 102. Such pressure drives the ball into the valve seat 103 to prevent further flow, until the pressure in the tube 104 is reduced sufficiently to allow water flow from the spacer 105 to refill the tube 104 through the liner port 107. The foregoing technique advantageously allows, for example, the system embodiment of FIG. 6 to monitor continuously the water level changes in the formation, yet still preserves the advantages of a positive displacement pumping system. (A potential compromise of the alternative valve 101 in FIG. 10 is that it is relatively bulky, and may not easily evert with the liner 106 into smaller boreholes.

Figure 11:
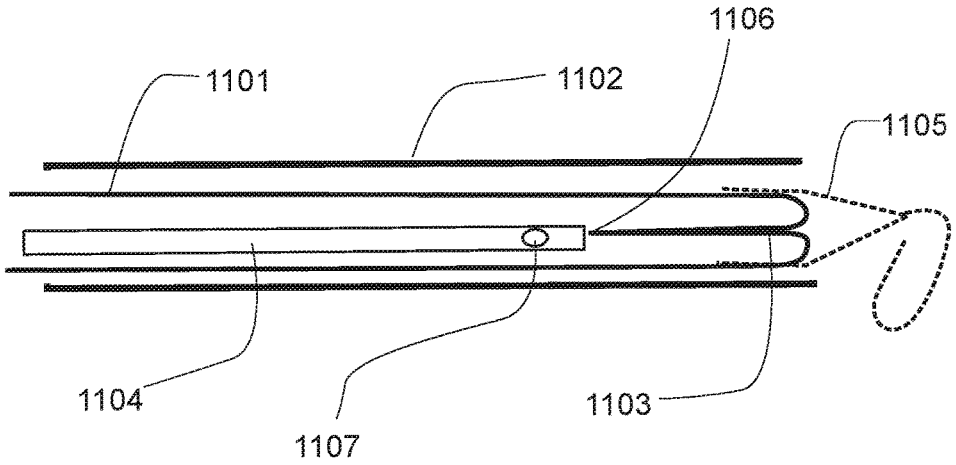
FIG. 11 is a simplified sectional view showing the assembly of an apparatus according to the present disclosure utilizing a flexible hose with mud tube.

FIG. 11 illustrates an instructive segment of another potential geometry of the present compact and flexible system, for lining a borehole. For this alternative installation, the flexible liner system 1101 is not inverted for shipping to the borehole site, as would be when it is to be everted into the borehole. Rather, the full liner system 1101 (including interiorly sleeved tube(s) and operably associated spacers), with its right side out (i.e., the side of the liner that is to contact the borehole wall faces radially outward), is compactly collapsed and drawn into a flexible protective hose 1102. The hose 1102 has an outside diameter (e.g., from about two inches to and including about four inches) that is less than that of the borehole of emplacement. Only a bottommost portion 1103 (e.g., approximately five feet length) of the liner 1101 is inverted, as shown to the right side of FIG. 11. A draw cord 1105 is temporarily, releasably, attached to the bottom end of the liner 1101 (at the initial point of liner inversion) as shown. The draw cord is used to draw the liner system 1101 into the interior of an appropriately selected length of hose 1102. The hose is used to emplace the liner down the borehole, as described hereafter. Using the cord 1105, the liner system 1101 is pulled into the interior of the flexible hose 1102. Upon completion of this drawing action, the length of radially collapsed liner system 1101 runs concentrically along the interior length of the surrounding hose 1102.

Continued reference is made to FIG. 11. For this embodiment, the tether 210 (i.e., of FIG. 2) is replaced with a flexible slurry tube 1104 of appropriate diameter (e.g., approximately ¾-inch (0.750) diameter). The slurry tube 1104 is mechanically attached to the closed absolute end of the liner at juncture 1106. The slurry tube 1104 near its distal end has an open hole 1107 to permit discharge of fluid from within the slurry tube. After the slender liner assembly 1101 has been drawn into the hose 1102, the draw cord 1105 is detached from the liner 1101. The concentrically disposed liner and hose assembly then is conveniently spooled or rolled onto a small reel (not shown in FIGS. 11-13, but see FIGS. 3 and 14) for shipment to the borehole site for emplacement. When spooled for shipment, the bottom (distal) end of the combined liner/hose assembly (e.g. at 1103) is conveniently presented on the outside of the roll on the reel. Accordingly, the bottom end (1103) of the liner and hose combination is the end first paid out from the reel on-site, and is the leading end deployed down the borehole as the rest of the combination is unspooled behind it. The sample tubes preferably are slender, having a diameter of less than ⅜ inch (0.375 inch), which promotes the compactness of the liner system for insertion inside the protective hose. Advantageously, however, non-slender sample tubes of a diameters in excess of ⅜-inch diameter (which due to their stiffness may be difficult or impossible to evert along with an everting liner) potentially may be used in a system installed using this protective hose mode of installation, which does not require the eversion of the full length of the liner and tubes.

Figure 12:
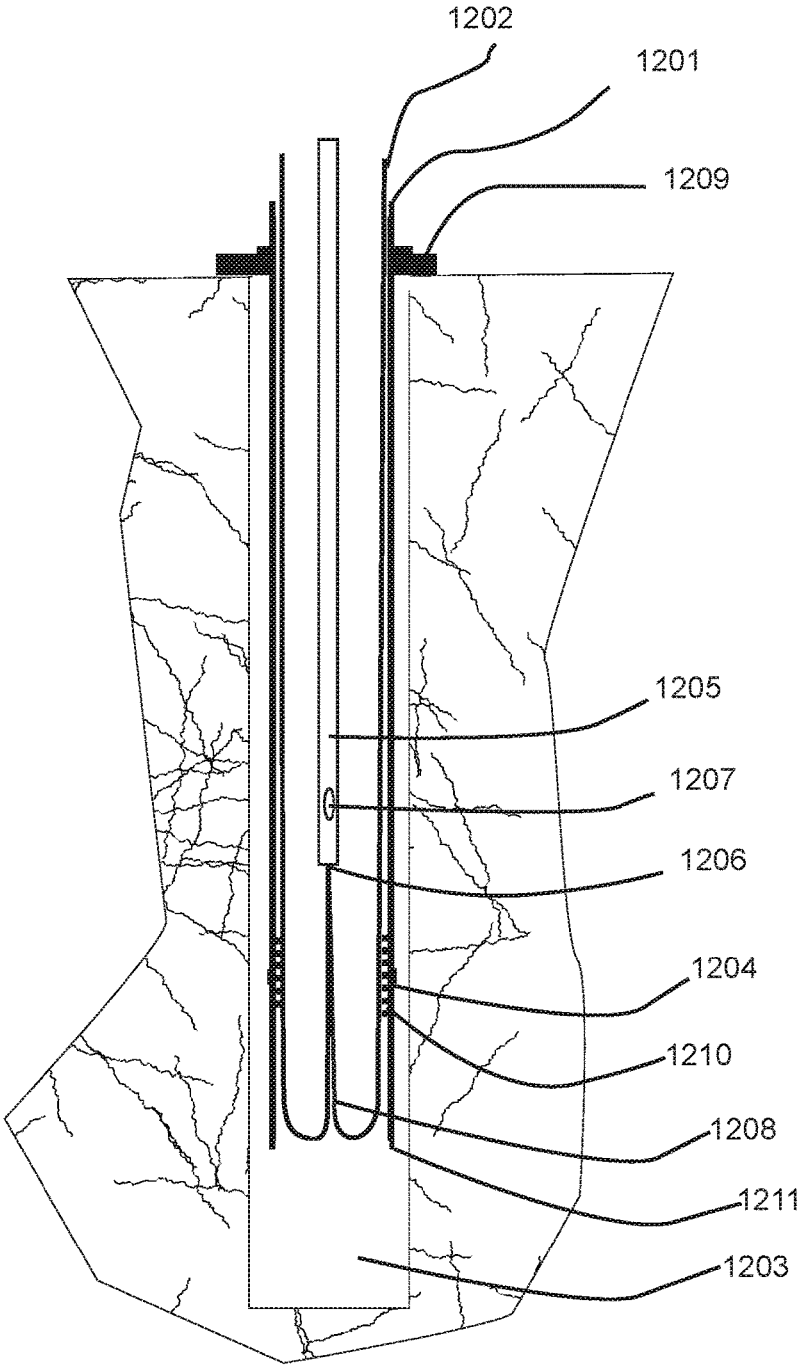
FIG. 12 is a side elevation sectional view showing the installation of an embodiment of the present system, inside an exterior hose with an inverted end section, into a borehole.

FIGS. 12-15 illustrate serially the mode and manner of practicing the hose-contained embodiment of the present compact liner system and method. After the shipping reel with the liner/hose assembly is placed on a stand (not shown) on site near the borehole, the hose 1201 with the liner 1202 contained therein is lowered into the borehole 1202 as shown in FIG. 12. The hose 1201 is controllably supported by a cord (not shown) attached to the top end of the hose, which remains connected to the shipping reel on the surface of the ground; the position of the hose (up and down) within the borehole accordingly can be selectively adjusted. A support of the hose 1201 can also be provided with a suitable collar 1209 at the ground's surface. As the hose 1201 is lowered, ambient water in the borehole is free to flow into the open bottom end 1211 of the hose 1201, and axially between the inside wall of the hose 1201 and the compact liner 1202. After reaching the bottom 1203 of the borehole 1202, the bottom end of the hose 1201 is lifted (along with the interiorly contained liner 1202) above the bottom 1203 of the borehole to adjust the interior liner 1202 and associated spacer(s) 1204 (only one shown in FIG. 12) to the elevation(s) desired for proper location of the spacer (s) 1204 in relation to the surrounding geologic media of interest.

Figure 13:
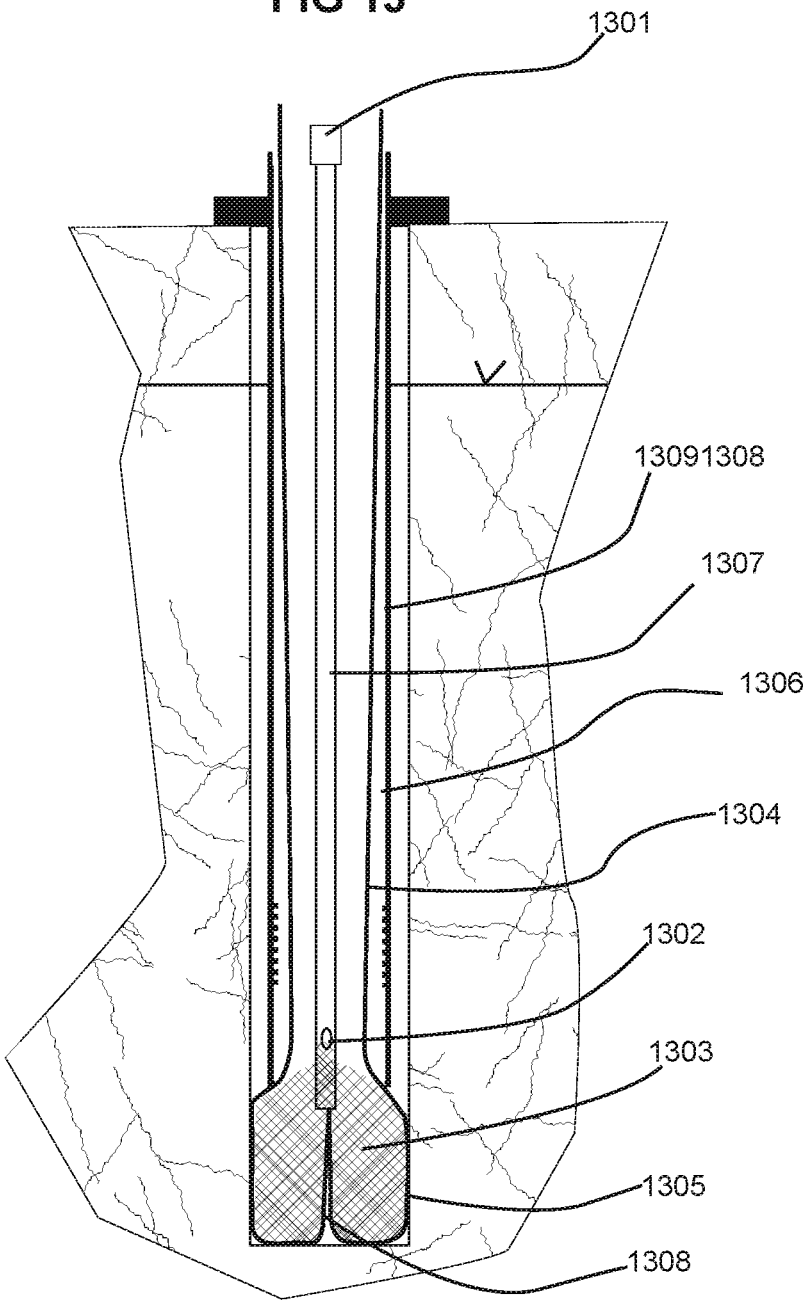
FIG. 13 is a side elevation view, related to the view of FIG. 12, illustrating the everted end section of the liner in place and filled with mud, before the hose is withdrawn.

Reference is advanced to FIG. 13 showing the hose 1309 and liner 1304 disposed down the borehole. A heavy mud is then pumped via a fitting 1301 down through the inside of slurry tube 1307 (element 1104 in FIG. 11; element 1205 in FIG. 12), which tube is attached to the inverted end of the liner 1304 at juncture 1206 (FIG. 12). The mud flows out the open hole 1302 (hole 1107 in FIG. 11) in the end of the slurry tube 1307 and into the inside of the bottom volume 1303 of the inverted portion of the liner 1304. The pressure of the heavy mud in bottom volume 1303 causes the liner 1304 to evert to the bottom 1308 of the borehole, as seen in FIG. 13. This method allows the bottom end of the liner 1304 to be supported on the bottom of the borehole at 1308, even with uncertainty of the actual borehole depth due to potential backfill on the borehole bottom by slough from the borehole wall. This ability to adjust the liner depth position within the borehole is important for the proper locating of the spacers 1204, there being some uncertainty of the borehole depth when the liner system 1304 is manufactured and at the time the hose/liner system is deployed.

FIG. 13 shows the liner 1304 everted down from the distal or bottom end (element 1211 in FIG. 12) of the hose 1309, as dilated by the mud pressure (in liner volume 1303) against the borehole wall. The dilated liner 1304, and friction of the liner 1304 against the borehole at borehole wall 1305, anchor the liner system in the borehole. Borehole water fills the annulus 1306 between the outside of the liner 1304 and the inside of hose 1309. (As mentioned previously, this ambient borehole water flowed into the annular space 1306 as the hose 1309 was lowered into the borehole.) A modest amount of water added to the interior of the liner 1304 via the slurry tube 1307, prior to the mud addition, allows the slurry tube 1307 to descend more easily with the attachment juncture 1206 (FIG. 12) as the mud in the volume 1303 drives the everted portion of the liner against the bottom wall portion 1305 and bottom 1308 of the borehole.

Figure 14:
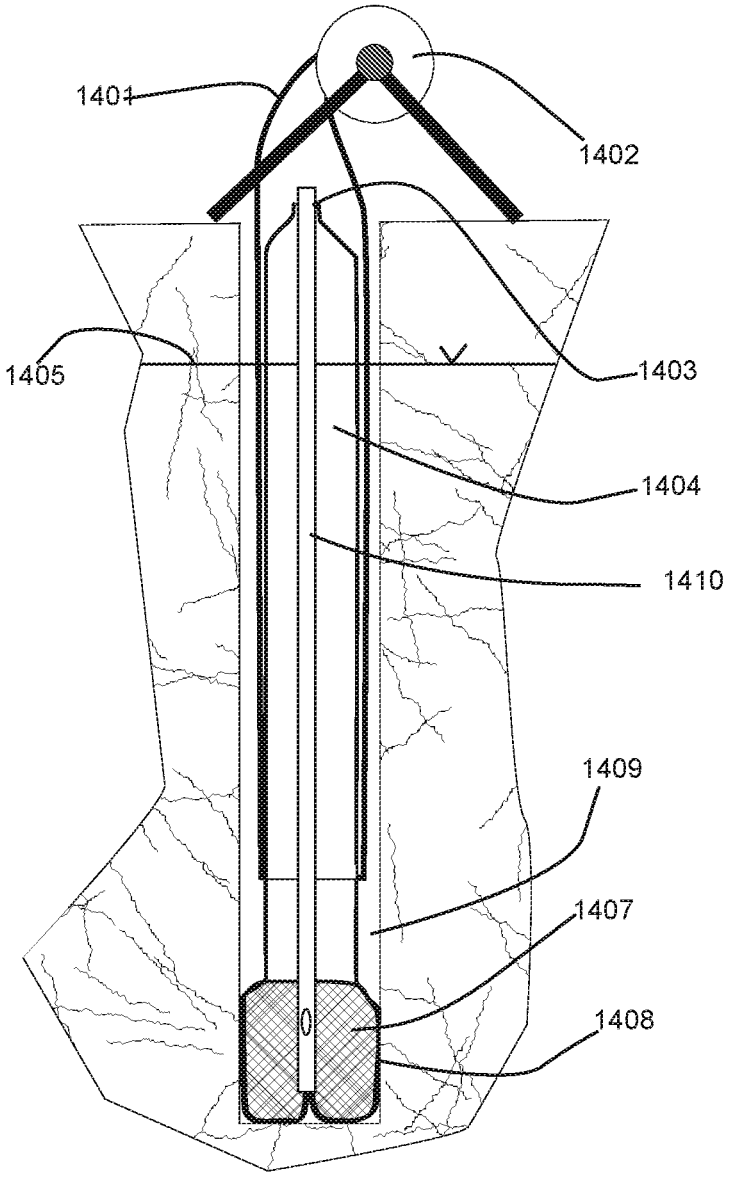
FIG. 14 is a side elevation view, related to the view of FIG. 13, illustrating the withdrawal of the exterior hose onto an original shipping reel.

The hose 1401 is then rolled back onto the reel 1402, or otherwise removed completely from the borehole, leaving the liner in proper place within the borehole. FIG. 14 shows the protective deployment hose 1401 being withdrawn from the borehole, preferably by means of and onto the original shipping reel 1402, thereby leaving the liner 1404 in place in the borehole. The presence of water between the inside of the hose 1401 and the outside of the liner 1404 ameliorates significantly and advantageously the frictional drag between the stationary liner and the rising hose during the hose's removal from the borehole. Notably, the annular water between the liner 1404 and the interior surface of the hose 1401 is in pressure equilibrium with the water within the interior of the liner 1404 because the liner is highly non-elastically flexible.

After the hose 1401 has been completely extracted from the borehole, the interior of the previously collapsed liner 1404 is at least partially filled with water via the same slurry tube 1410 used to perform the mud fill. The at least partial filling of the liner 1404 interior with water dilates the liner thereby to press its outside surface against the inside wall of the borehole, thus sealing the borehole (except at the selected elevations where any spacers are situated). (Alternatively, the liner interior 1404 can be filled in whole or part with a heavy mud to seal the liner to the borehole wall). The liner 1404 thus is in place to perform the sealing and/or sampling and/or monitoring functions for which it is intended.

For shallow water tables, it is more likely that a heavy mud is used to obtain the better sealing pressure within the dilated liner 1404. As the mud fills the liner through the slurry tube 1410 and bottom opening therein, the mud 1407 level rises and displaces upwards any water within the annulus 1409 between the liner and borehole wall. This annular water can be removed with a pump at the ground's surface, and/or may be allowed to flow back into the surrounding formation. After the liner 1404 has been filled and dilated, a wellhead assembly is installed which organizes the sampling tubing in a convenient array for use.

Prior to the removal of the hose 1401, water optionally but preferably may be added to the interior of the liner 1404 to partially fill the liner (e.g., approximately 25% of the liner volume). Such a partial fill assures that the mud 1407 is pressurized by the water column height 1405 above the mud 1407, so to develop the greater pressure against the lower borehole wall 1408, and thus a better anchor of the liner 1404 to the borehole wall, to promote removal of the hose 1401. This technique is effective for the removal of the hose 1401 without lifting the liner 1404 from its preferred elevation in the borehole.

Figure 15:
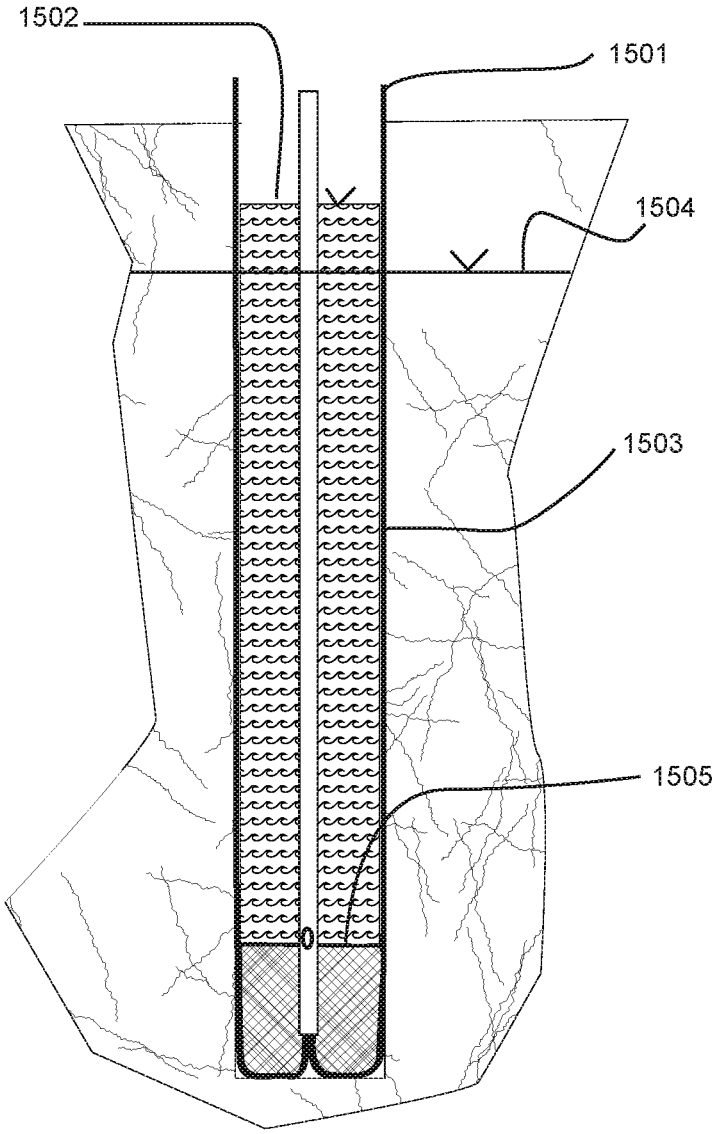
FIG. 15 is a side elevation view, related to the view of FIG. 14, illustrating the system in place after being filled with water or mud.

FIG. 15 shows an embodiment of a complete liner system 1503 (including interior tubing sleeves, sampling slender tubes, and spacers (not specifically shown), if any) fully installed after the protective hose removal. A mud fill 1505 occupies the bottom portion, or a larger portion, of the liner interior volume. The water level 1502 above the mud within in the liner is maintained above the formation water table 1504. As mentioned, the slender tubing and spacers of a full multi-level system are not depicted in FIG. 15, but are present according to the disclosure of FIG. 2 an associated discussion above. It is notable that this hose installation method can be used for a "blank" liner—a liner 1503 without associated slender sampling tubing, spacers, or other associated attachments.

Because a bulky liner system according known conventions cannot be emplaced in a hose smaller in diameter than the borehole, it is an advantage of this compact and slender system that it can be emplaced in the small-diameter (e.g., four-inch diameter) protective hose, and the hose later withdrawn without excessive friction. Experience has shown that simply lowering the liner system into a borehole without a protective hose results in many abraded holes in the liner, compromising or destroying its essential impermeability in place within the borehole. Both the eversion installation of the liner (FIG. 3) and the hose installation avoid such an abrasion hazard to the liner seal. A further advantage of the hose installation methodology of FIGS. 11-15 is that somewhat larger-diameter sampling tubes can be disposed in the liner sleeves; larger sampling tubes often are too stiff to be flexed and bent (along with the everting liner) during installation down the borehole. (Kinking a sampling hose during sharp bending can compromise its proper function.) A primary (but not exclusive) purpose of the disclose hose installation method thus is to protect the liner from abrasion against the borehole wall.

It also is noteworthy that liner installation through the protective hose does not generally prohibit the inversion of the liner system for removal. If more rigid sampling tubing is used in the liner's interior sleeves, the liner system can be pumped empty of water and lifted from the borehole. This ease of removal is a significant advantage of the design of the flexible liner systems.

Because most commercial hose construction includes a rubber or soft PVC interior surface, it has been determined that the high friction of such an interior hose surface can prevent the protective hose removal without lifting the contained liner. The outside surface of suitable hosing preferably has a low-friction woven fabric composition. Common fire hose accordingly has been inverted (turned inside out) to present to the contained liner the much lower friction fabric surface of the hose for this application. This method permits a suitable and economical use of commercially available hose for containing and protecting the flexible liner.

In summary, the system according to the present disclosure offers improved and alternative means and methods for exploiting everting flexible liner apparatuses and methods. The combination of the unique features of this design allows an exceptionally economical system to perform measurements that usually are much more expensive and with inferior spatial and temporal resolution. The liner seal avoids the emplacement of sealing grouts to obtain seals outside of standard casing designs and prevents the risk of degradation of the water sample quality. Because the system is more compact and of lighter weight, it is considerably less expensive to ship than know systems. The installation procedures are also less labor intensive than those of known systems, so as to allow installations of multi-level measurement systems at a rate of several per day instead of the one or two days required by other currently known systems. None of the other systems known in the art, and which do not use the flexible liner seal, are so easily removed.

Because the interior space of the present liner system is devoid of hardware (except for the tether or central slurry tube), it is very easy to lower pumps (and other devices) into the interior of this liner; the lowering of pumps or other equipment normally is incompatible with the relatively bulky tubing bundles found in other multi-level sampling flexible liner designs, such as the known configuration illustrated generally in FIG. 1. The individual subsystems/apparatus described for use with the presently disclosed system and method are either patented or used by the present applicant. But they are not the invention of the present disclosure; rather, the foregoing disclosure is a convergence of applicant's experience in the pursuit of the most economical and still fully functional device for the hydrologic measurements described.

Other useful aspects of this system, such as practicing the present system and technique in combination with diffusion barrier systems as actually manufactured (see U.S. Pat. No. 7,841,405 ("Flexible Borehole Liner with Diffusion Barrier")) to assure higher quality water samples, also may be exploited with the presently disclosed system, but such details may only complicate the present description and thus detract from the essential simplicity of the design. Applicant innovates in non-obvious ways to evolve advantageously his designs from the more complex toward the simple. The necessity of competing in the market at lower cost is a significant motivation and advantage of this invention. The enhanced utility is a significant benefit.

Only some embodiments of the invention and but a few examples of its versatility are described in the present disclosure. It is understood that the invention is capable of use in various other combinations and is capable of changes or modifications within the scope of the inventive concept as expressed herein. Thus, although the invention has been described in detail with particular reference to these preferred embodiments, other embodiments can achieve the same results. Variations and modifications of the present invention will be obvious to those skilled in the art and it is intended to cover with the appended claims all such modifications and equivalents. The entire disclosures of all patents cited hereinabove are hereby incorporated by reference.

I claim:

1. A method for lining a subsurface borehole, comprising:
- providing a flexible tubiform liner having an outside surface, an inside surface, and an axial length;
- disposing at least one tubing sleeve upon the liner's inside surface and along at least a major segment of the length;
- providing at least one spacer on the liner's outside surface;
- defining at least one liner port through the liner, wherein each of the at least one liner port is adjacent to, and in fluid communication with, one of the at least one spacer;
- situating a sample slender tube in fluid communication with each of the at least one liner port, and along and within the at least one tubing sleeve and ascending toward a top of a borehole; and
- placing the liner's outside surface against a borehole wall.

2. The method of claim 1 wherein the step of providing at least one spacer comprises providing a plurality of spacers at different locations along the length.

3. The method of claim 1 wherein the step of placing the liner's outside surface against a borehole wall comprises everting the liner down the borehole, and wherein further the step of situating a sample slender tube comprises situating a slender tube having a diameter less than 0.375 inch, and further comprising:
- connecting a vacuum water level meter system at or near the top end of the slender tube,
- comprising:
  - placing a meter tube above the surface of the ground;
  - placing an upper portion of the slender tube in fluid communication with a bottom of the meter tube; and
  - applying a vacuum to the meter tube; and
- metering a water level in the slender tube, comprising:
  - drawing, with the vacuum, water in the slender tube from a first level in the slender tube to a second level inside the meter tube;
  - preventing a further rise of the water in the meter tube;
  - measuring, with a vacuum gauge on the meter tube, the magnitude of a vacuum in a meter tube space above the second water level in the meter tube;
  - measuring the height of the second water level above the surface of the ground;
  - subtracting the height of the second water level from a height of an equivalent water column of the vacuum magnitude measured with the vacuum gauge; and
- determining a depth of the first water level below the surface of the ground before the application of the vacuum to the meter tube.

4. The method of claim 1 wherein the step of placing the liner's outside surface against a borehole wall comprises everting the liner down the borehole, and wherein further the step of situating a sample slender tube comprises situating a slender tube having a diameter less than 0.375 inch, and further comprising:

drawing a borehole water sample from the slender tube, comprising:

placing a peristaltic pump in fluid communication with an upper portion of the slender tube above the surface of the ground;

operating the peristaltic pump to apply a controlled vacuum to the slender tube;

drawing, by the vacuum, the borehole water sample from the at least one spacer, and through the slender tube, to the pump; and expelling the borehole water into a sample container.

5. The method of claim 1 wherein the step of placing the liner's outside surface against a borehole wall comprises everting the liner down the borehole, and wherein further the step of situating a sample slender tube comprises situating a slender tube having a diameter less than 0.375 inch, and further comprising:

monitoring continuously in time the water level the slender tube, comprising:

connecting, while the transducer is above the ground's surface, a pressure transducer to an upper portion of the slender tube;

lowering the transducer beneath a water level within an interior of the liner;

measuring, with the transducer, changes in air pressure within the slender tube and above the water level in the slender tube; and recording the measured pressure changes.

6. The method of claim 1 wherein the step of providing at least one tubing sleeve comprises providing two tubing sleeves upon the liner's inside surface.

7. The method of claim 6 wherein the step of situating a sample slender tube comprises situating between one and seven slender tubes in each of the two tubing sleeves.

8. The method of claim 1 wherein the step of situating a sample slender tube comprises situating two or more slender tubes within the at least one tubing sleeve.

9. The method of claim 8 wherein the step of situating two or more slender tubes comprises situating two or more slender tubes having a diameter selected from the group consisting of 0.1875 inch, 0.25 inch, and 0.375 inch.

10. The method of claim 1 further comprising:

collapsing the liner;

drawing the liner into an interior of a protective hose, with the liner's outside surface in confronting relation with an inside surface of the protective hose;

lowering down the borehole the protective hose with the liner therein; and anchoring a bottom end of the liner in the borehole.

11. The method of claim 10 further comprising;

disposing a slurry tube within the liner;

defining a hole in the slurry tube near its distal end;

inverting a bottom portion of the liner;

attaching a bottom end of the liner to the distal end of the slurry tube.

12. The method of claim 11 further comprising pumping a mud through the slurry tube, out the slurry tube hole, and into the inverted bottom portion of the liner; whereby the step of anchoring a bottom end of the liner comprises:

everting the bottom portion of the liner;

pressurizing with the mud the interior of the bottom portion of the liner; and dilating the bottom portion of the liner against the bottom of the borehole and against a portion of the borehole wall.

13. The method of claim 12 wherein the step of placing the liner's outside surface against a borehole wall comprises:

removing the protective hose from the borehole while leaving the liner within the borehole; and at least partially filling with water the interior of the liner to dilate the liner thereby to press the outside surface against the borehole wall.

14. The method of claim 13 wherein situating a sample slender tube comprises situating a sample slender tube having a diameter of at least 0.375 inch.

15. A method for lining a subsurface borehole, comprising:

providing a flexible tubiform liner having an outside surface, an inside surface, and an axial length;

disposing at least one tubing sleeve upon the liner's inside surface and along at least a major segment of the length;

providing at least one spacer on the liner's outside surface;

defining at least one liner port through the liner, wherein each of the at least one liner port is adjacent to, and in fluid communication with, one of the at least one spacer;

situating a sample slender tube in fluid communication with each of the at least one liner port, and along and within the at least one tubing sleeve and ascending toward a top of a borehole;

collapsing the liner;

drawing the liner into an interior of a protective hose, with the liner's outside surface in confronting relation with an inside surface of the protective hose;

lowering down the borehole the protective hose with the liner therein;

anchoring a bottom end of the liner in the borehole; and placing the liner's outside surface against a borehole wall.

16. The method of claim 15 further comprising;

disposing a slurry tube within the liner;

defining a hole in the slurry tube near its distal end;

inverting a bottom portion of the liner;

attaching a bottom end of the liner to the distal end of the slurry tube.

17. The method of claim 16 further comprising pumping a mud through the slurry tube, out the slurry tube hole, and into the inverted bottom portion of the liner; whereby the step of anchoring a bottom end of the liner comprises:

everting the bottom portion of the liner;

pressurizing with the mud the interior of the bottom portion of the liner; and dilating the bottom portion of the liner against the bottom of the borehole and against a portion of the borehole wall.

18. The method of claim 17 wherein the step of placing the liner's outside surface against a borehole wall comprises:

removing the protective hose from the borehole while leaving the liner within the borehole; and at least partially filling with water the interior of the liner to dilate the liner thereby to press the outside surface against the borehole wall.

19. The method of claim 18 wherein situating a sample slender tube comprises situating a sample slender tube having a diameter of at least 0.375 inch.

* * * * *